US005189955A

United States Patent [19]

Su et al.

[11] Patent Number: 5,189,955

[45] Date of Patent: Mar. 2, 1993

[54] AUTOMATIC INKING MECHANISM FOR PAPERBOARD PRINTING MACHINES

[76] Inventors: Shun-Fa Su, No. 10, Alley 28, Lane 917, Kang Shan South St., Chien Chen District, Kaohsiung; Ching C. Lin, No. 22-3, Lane 80, Wu Ching 2nd Rd., Feng Shan City, Kaohsiung County, both of Taiwan

[21] Appl. No.: 917,401

[22] Filed: Jul. 23, 1992

[51] Int. Cl.[5] ..... B41F 31/06; B41F 31/14; B41F 31/36

[52] U.S. Cl. ..... 101/351

[58] Field of Search ..... 101/366, 350, 349, 148, 101/207, 208, 209, 210, 351, 352, 363; 118/244, 256, 266

[56] References Cited

U.S. PATENT DOCUMENTS 4,787,313 11/1988 Osborn et al. ..... 101/366

*Primary Examiner*—J. Reed Fisher

*Attorney, Agent, or Firm*—Morton J. Rosenberg; David I. Klein

[57] ABSTRACT

The present invention relates to an automatic inking mechanism used on a common paperboard printing machine, it mainly comprises a framework reciprocatively movable on a pair of rack rails. Induction means disposed on the framework actuates a cylinder attached to the framework to move up and down an ink reservoir from which adequate amount of ink can be automatically applied to rollers of the printing machine for printing patterns at preset positions on a paperboard with even ink consistency and clear printed letters or patterns. Both the quality and efficiency of printing are largely improved.

2 Claims, 4 Drawing Sheets

AUTOMATIC INKING MECHANISM FOR PAPERBOARD PRINTING MACHINES

BACKGROUND OF THE INVENTION

The present invention relates to a mechanism for automatic inking at predetermined points on a paperboard printing machine.

For a traditional paperboard press, ink is applied to the rollers of the press by an operator using an ink brush. Since the rollers rotate at high speed, the operator has to stand beside the rollers when applying ink to the rollers. Accidents frequently happen when an ink brush or even the hand of operator is unexpectedly clamped by the rotating rollers. Apart from the accidents, disadvantages from manual inking based on visual judgement, such as variable amount of ink applied, unevenly and untimely applied ink, error in inking positions, missed application of ink, etc. might very possibly cause the resulted printing on the paperboard to be smudgy, unclear, poor effect, etc.

Articles to be printed on a paperboard press are usually unfolded paperboard used to making cartons. The paperboard (which is generally the so-called corrugated board) is usually printed with what we commonly refer to as shipping marks. The marks can be further classified into a master mark which is larger in size and is shown on the front side of a carton for showing the description of the article contained therein or trademark thereof, and a side mark which is smaller in size and is shown on side and/or bottom faces of a carton for showing address and/or phone number of the consignee, or other descriptive letterings. Usually, amount of ink used relates to the size of printed marks or letters. For the master marks in which larger letters are used, ink of higher consistency and richer amount is required, and, for the side marks, less ink is required.

To eliminate the drawbacks existed in the traditional manual-inking press, automatic inking printing machines are developed. However, such conventional automatic inking printing machines would usually cause additional loss or consumption of ink because the entire surface of the roller must be applied with ink; besides, amount of ink applied to print the paperboard is the same for every part of the board, that is, the ink consistency for printing master marks and for side marks is the same, and therefore, not every marks or letters may have desired degree of clearness, that is, smaller letters would be smudged if the larger letters got the desired clearness, and reversely, the larger letters might be too light if the smaller letters got the desired clearness.

In view of these disadvantages, it is necessary to have another improved automatic inking mechanism which may evenly supply adequate amount of ink to the roller to meet different ink consistency required by printed marks or letters in different sizes lest ink should be unnecessarily wasted.

SUMMARY OF THE INVENTION

The automatic inking mechanism according to the present invention is installed at a proper position above the top roller of a common paperboard printing machine. The machanism mainly consists of a framework which is reciprocatively movable on a pair of rails when driven by a motor, an ink reservoir which may be driven by an actuated cylinder connected to bottom of the framework to shift up and down above the roller, and an induction member provided on the framework which may sequentially induce a plurality of inducers separately disposed at adequate positions along one of the rails on which the framework reciprocates. When the framework moves, the induced inducers causes the cylinder to to actuate the ink reservoir to supply ink to the top roller of the printing machine at preset points.

When the present invention is properly installed on a traditional paperboard printing machine above the top roller, ink may be economically saved through the automatic inking at preset points while better printing quality may be achieved through ink applied with even consistency and clear printed marks or letters.

DETAILED DESCRIPTION OF THE PREFERRED EMBODIMENTS

Figure 1:
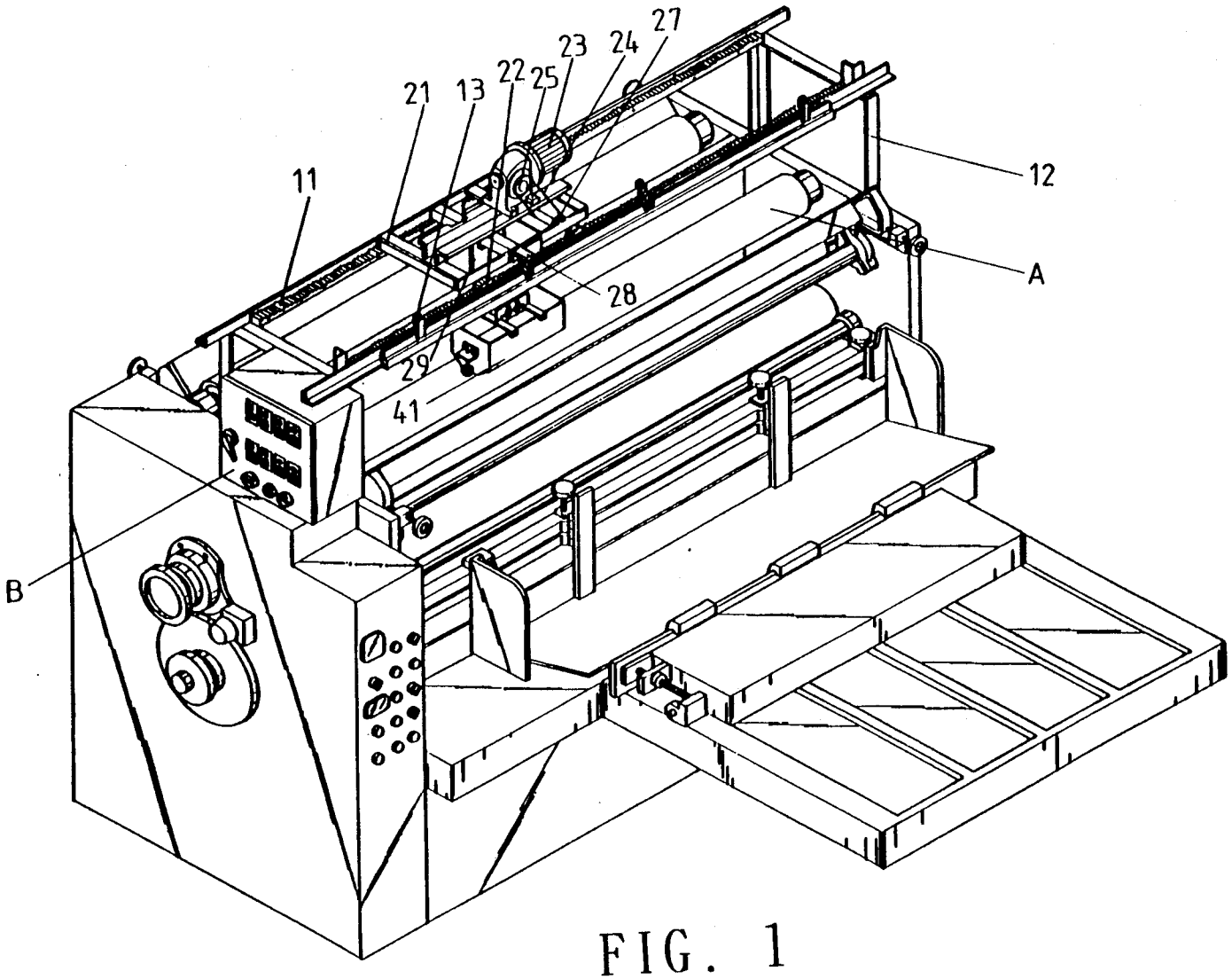
FIG. 1 is a three-dimensional perspective showing a paperboard printing machine installed with the present invention.

Please refer to FIG. 1 in which the referential number of A is designated to the uppermost roller of a common paperboard printing machine. A common paperboard printing machine has a group of cylinders or rollers arranged from top to bottom. When the uppermost roller A is applied with ink, ink thereon shall be passed to the bottom roller through the frictional transmission by the intermediate rollers. The purpose of the present invention is to timely supply adequate amount of ink at preset points on the uppermost roller A of the common paperboard printing machine.

Figure 2:
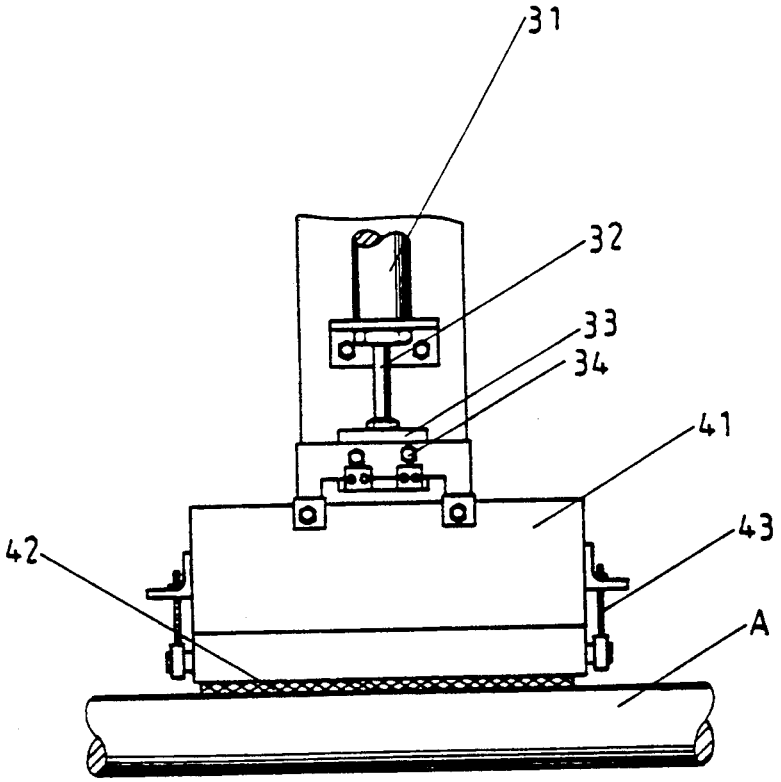
FIG. 2 is a three-dimensional perspective showing the cylinder and the ink reservoir used in the present invention.

To install the present invention on a paperboard printing machine, a pair of supporting frames 12 are mounted on top of the printing machine at adequate positions near two ends thereof to support two rack rails 11 parallelly extending across the printing machine such that they are generally located above the roller A. A framework 21 is disposed on the pair of rack rails 11 and is reciprocatively movable thereon by means of four gears 22 provided at four corners of the framework 21 engageable with the rack rails 11 when the framework 21 is driven to move by a motor 23. A transmission belt 24 is used to connect a first belt wheel 25 of the motor 23 and a second belt wheel 27 provided on a bottom shaft of the framework 21 so that the motor 23 can drive the framework 21 to move. An induction member 28 is provided on front edge of the framework 21 at a proper position. A plurality of inducers 13 are adjustably disposed along one of the rack rails 11 adjacent to the induction member 28. Below the framework 21, a panel 29 is connected thereto and a cylinder 31 (as shown in FIG. 2) is fixed on the panel 29 at a proper position. When the induction between the induction member 28 and the inducers 13, the motor 23 and the cylinder 31 are actuated.

Figure 3:
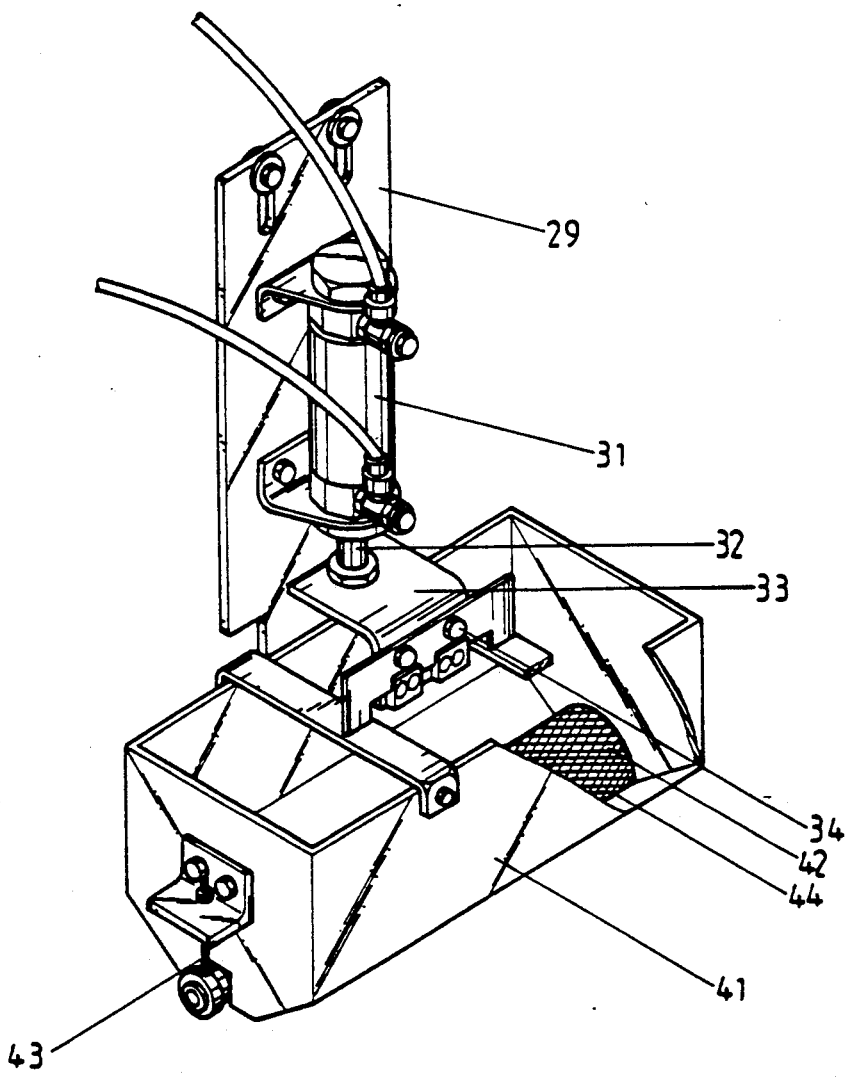
FIG. 3 is a front elevational view showing the cylinder and the ink reservoir in FIG. 2 above the top roller of the paperboard printing machine.

Please refer to FIG. 2, the cylinder 31 is vertically fixed to the panel 29 and has a downward extended pushrod 32 to bottom end of which an L-shaped plate 33 is fixedly connected. An ink reservoir 41 is screwed to the L-shaped plate 33 with fixing screws 34. Ink as required may be contained in the ink reservoir 41. The ink reservoir 41 has a generally V-shaped bottom portion with a slit 44 extending full length of the ink reservoir 41. An embossed roller 42 is disposed in the ink reservoir 41 such that it lies on the slit 44 with its two ends separately extending out of two ends of the ink reservoir 41 and connected to the ink reservoir 41 by bolts 43. The bolts 43 also serve as adjusting screws to adjust gap between the embossed roller 42 and the slit 44. Please refer to FIG. 3, the ink reservoir 41 may move up and down through the reciprocation of the pushrod 32 of the cylinder 31 in vertical direction. When the ink reservoir 41 is at a down position, the embossed roller 42 is allowed to adequately contact the uppermost roller A of the paperboard printing machine. When the roller A rotates, the embossed roller 42 is frictionally driven to rotate. The embossed surface of roller 42 in rotation shall cause the ink in the ink reservoir 41 to be applied to the roller A more evenly than by manual inking.

Figure 4:
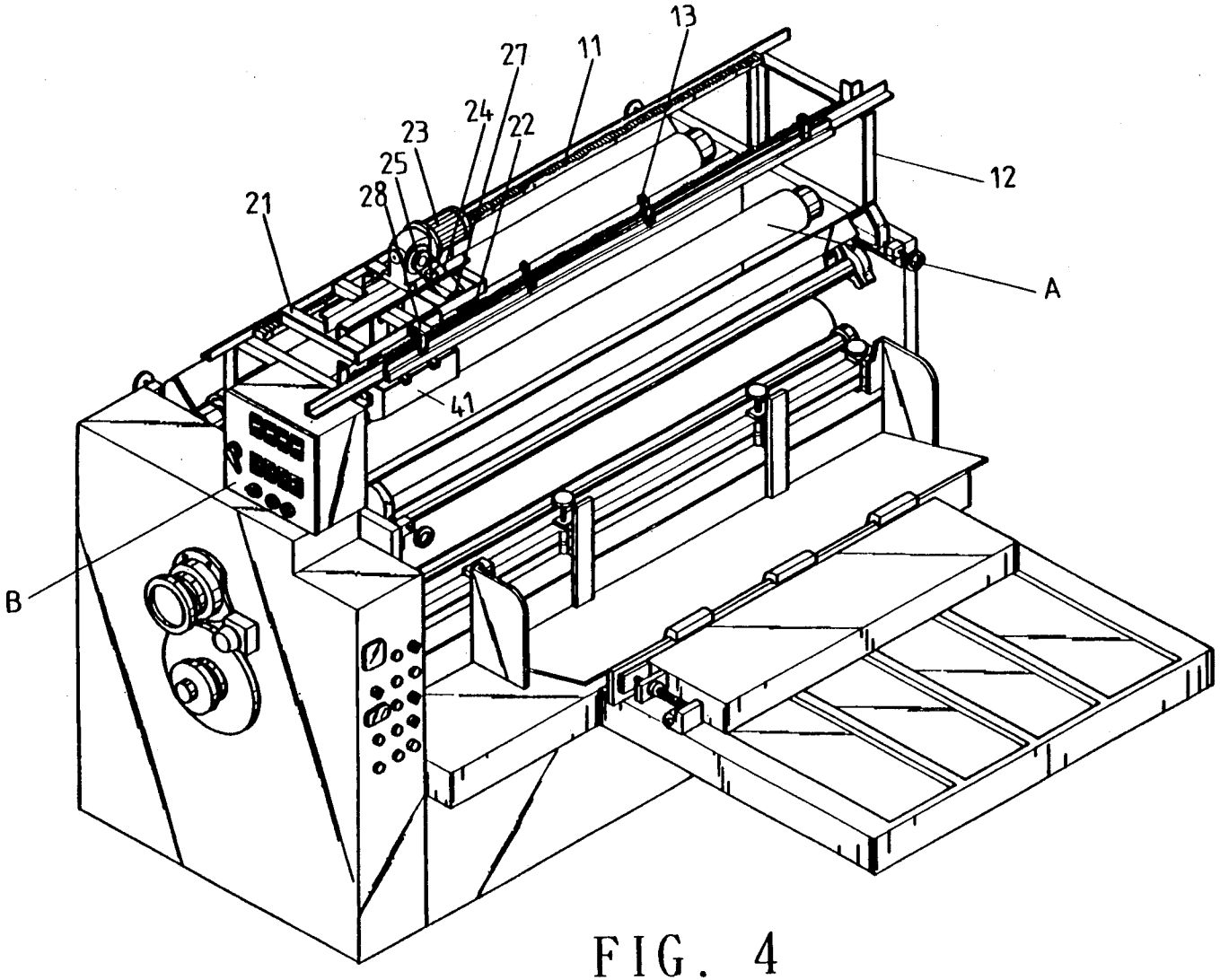
FIG. 4 shows an embodiment of the present invention.

To operate the present invention, first adjust the inducers 13 so that their positions correspond to where a shipping mark, for example, is to be printed on a paperboard. The initial induction position is where the framework 21 stops at the left end of the rack rails 11, at where the induction member 28 induces the first inducer 13. The framework 21 is then caused to move rightward until the induction member 28 induces the second inducer 13, i.e. the inducer at where the shipping mark is to be printed (as shown in FIG. 4). At this point, the framework 21 stops moving and the pushrod 32 of the cylinder 31 is actuated to move downward, causing the ink reservoir 41 to move down, too, allowing the embossed roller 42 to contact and press against the roller A. The rotation of roller A causes the embossed roller 42 to rotate, the rotating embossed roller 42 in turn evenly passes ink in the ink reservoir 41 to the roller A, and then to the other rollers for printing. A time switch in a control switch box B located adjacent to one end of the roller A may be set to control the duration for which the cylinder 31 is moving downward. Since the time switch is a known art, it is not particularly described herein. To speak more specifically, the amount of ink applied to the roller A at a certain location is controlled by the time for which the embossed roller 42 contacts with the roller A. When the application of ink is completed by allowing the embossed roller 42 in the ink reservoir 41 to fully contact the roller A for the preset period of time, the cylinder 31 actuates the pushrod 32 to move upward and the framework 21 shall move rightward to the third, fourth inducers 13, etc. one after another, repeating the same movement as described above. The induction at each position to be printed and the time for which the embossed roller 42 contacts with the roller A are preset based on the size of the letters and the desired ink consistency. When the printing on a paperboard is completed, the framework 21 with the induction member 28 moves to and induces the last inducer 13, the motor 23 runs in reverse direction, causing the framework 21 to move leftward. When the framework 21 moves leftward, the application of ink to the roller A may or may not be actuated depending on actual need. When the framework 21 returns to the most left or the first inducer 13, the previously described movement may be repeated to print another paperboard.

According to the above description, the amount and position of the inducers 13 may be adequately adjusted depending on the size of paperboard and the location to be printed to save a lot of time for printing and ink to use. Since the amount of ink applied may be controlled through the duration the embossed roller contacting with the roller A, different but adequate consistency of ink for letters or marks at different printing positions may be desirably controlled and thereby gives better printing effect.

The printing ink is a kind of viscous fluid in a semi-solid state, it would not leak from the slit 44 at bottom of the ink reservoir 41 even when the embossed roller 42 is not in rotating, so long as the slit 44 is not more than 0.20 mm in width. Moreover, the bolts 43 screwing the embossed roller 42 to the ink reservoir 41 are usually adjusted to allow the gap between the embossed roller 42 and the slit 44 suitable for normal printing requirements. However, the gap between the embossed roller 42 and the slit 44 may be enlarged by means of adjusting bolts 43 to allow more ink to be passed to the roller A for printing patterns to be fully printed. In the event ink of different color is required, just loose the fixing screws 34 fastening the ink reservoir 41 to the L-shaped plate 33, and replace it with another ink reservoir 41 containing ink of desired color.

What is claimed is:

1. An automatic inking mechanism installed on top of a common paperboard printing machine comprising:

a pair of supporting frames fixed on top of a paperboard printing machine at proper positions near two ends of said machine;

two rack rails parallelly and transversely extending between said pair of supporting frames at a position generally above an uppermost roller of said printing machine;

a plurality of inducers being disposed along one of said rack rails at proper positions;

a framework having four gears disposed at four corners thereof for engaging with said rack rails so that said framework is reciprocatively movable on said rack rails when said framework is driven by a transmission motor provided on said framework, and a downward extended panel to which a cylinder is vertically attached;

an induction member being attached to said framework at an adequate position so as to induce said inducers disposed on said one rack rail;

an ink reservoir being connected to said cylinder below said framework through an L-shaped plate connected to a pushrod of said cylinder and having a generally V-shaped bottom with a slit formed thereof; and an embossed roller being disposed in said ink reservoir with two ends extending out of two ends of said ink reservoir and being adjustably fixed thereto by bolts so that a variable gap is allowed between said embossed roller and a bottom of said ink reservoir; said embossed roller being allowed to adequately contact said uppermost roller of the printing machine when said cylinder actuates said pushrod thereof to move to a lower position, and the rotation of said uppermost roller permitting ink in said ink reservoir to be evenly passed to it through said embossed roller for printing.

2. An automatic inking mechanism as claimed in claim 1, wherein said inducers disposed on said rack rail are adjustably positioned in advance to correspond to positions at where patterns are to be printed on a paperboard; said inducers being induced by said induction member on said framework when said framework moves along said rack rails, said cylinder being actuated to move said ink reservoir up and down; and the duration for inking at preset points being able to be controlled by a time switch provided on said printing machine.

* * * * *